US006010316A

United States Patent [19]

Haller et al.

[11] Patent Number: 6,010,316

[45] Date of Patent: Jan. 4, 2000

[54] ACOUSTIC MICROPUMP

[75] Inventors: Matthew Isaac Haller, Mountain View; Butrus Thomas Khuri-Yakub, Palo Alto, both of Calif.

[73] Assignee: The Board of Trustees of the Leland Stanford Junior University, Palo Alto, Calif.

[21] Appl. No.: 08/587,360

[22] Filed: Jan. 16, 1996

[51] Int. Cl.[7] ..... F04B 35/00; F04B 17/00

[52] U.S. Cl. ..... 417/322; 417/412; 417/413.1

[58] Field of Search ..... 417/322, 412, 417/413.1, 413.2, 413.3

[56] References Cited

U.S. PATENT DOCUMENTS

| | | | |
|---|---|---|---|
| 4,171,852 | 10/1979 | Haentjens | 417/322 |
| 4,282,532 | 8/1981 | Markham | 417/322 |
| 4,296,417 | 10/1981 | Markham et al. | 310/800 |
| 5,212,988 | 5/1993 | White et al. . | |
| 5,525,041 | 6/1996 | Deak | 417/322 |

FOREIGN PATENT DOCUMENTS

| | | | |
|---|---|---|---|
| 3064700 | 3/1991 | Japan | 417/322 |

OTHER PUBLICATIONS

R.M. Moroney, R.M. White, R.T. Howe,"Ultrasonically induced microtransport with cylindrical geometry" presented at 1991 ASME Winter Annual Meeting, Atlanta GA, Dec. 1–6, 1991.

R.M. Moroney, R.M. White, R.T. Howe,"Microtransport induced by ultrasonic Lamb waves" Appl.Phys.Lett., vol. 59, No. 7, Aug. 12, 1991.

C.E. Bradley, R.M. White, "Acoustically driven flow in flexural plate wave devices: theory and experiment" presented at IEEE Ultransonics Symposium, Nov. 2–4, 1994, Cannes, France.

J.W. Grate, S.J. Martin, R.M. White, "Acoustic TSMSAW-FPWAPM Wave Microsensors" Part I, *Analytical Chemistry* 1993, 65, 940A–948A.

M.E. Motamedi, R.M. White, *Semiconductor Sensors,* Ch.3, Acoustic Sensors, pp. 97–151. John Wiley & Sons, Inc. 1994.

*Primary Examiner*—Charles G. Freay

*Attorney, Agent, or Firm*—Flehr Hohbach Test Albritton & Herbert LLP

[57] ABSTRACT

A micropump in which a fluid is pumped by the interaction of longitudinal acoustic waves and the fluid in the micro-channel. The micropump having an acoustical transducer responsive to a high-frequency input and directing a longitudinal acoustic wave into the channel which induces a pressure gradient. The fluid in the channel flowing in the direction of travel of the acoustic wave in the channel.

9 Claims, 6 Drawing Sheets

ACOUSTIC MICROPUMP

BRIEF SUMMARY OF THE INVENTION

This invention relates generally to an acoustic micropump and, more particularly, to microfabricated fluid pumps in which the fluid is caused to flow by interaction between a longitudinal acoustic wave and the fluid.

BACKGROUND OF THE INVENTION

High accuracy fluid pumps having flow rates on the order of microliters per minute ($\mu$l/min) which can be fabricated by micromachining techniques have gained interest in the last few years. Applications for micropumps include small dosage in-vivo drug release, on-chip cooling systems, integrated chemical analysis systems, chemical processing, and mixing.

Prior art microfabricated pumps have included flexible diaphragm valves working peristaltically and flexible diaphragm valved electrothermopneumatic liquid pumps. The flow of liquid in such pumps is pulsating. This type of pump also suffers from valve leakage. There is a need for a micropump which has no moving parts in which the fluid flow can be electronically controlled.

This invention uses longitudinal acoustic waves which travel along a microchannel and cause the liquid to flow in the direction of the acoustic wave as a result of pressure gradients caused by attenuation of the sound waves in the fluid or variations in radiation pressure in the channel or by both mechanisms.

OBJECTS AND SUMMARY OF THE INVENTION

It is a general object of this invention to provide a micropump in which fluid is caused to flow in a microchannel by the interaction between longitudinal acoustic waves and the fluid being pumped.

It is another object of the invention to provide a micropump which has no moving parts and can easily be fabricated by micromachining techniques.

It is another object of the invention to provide a micropump which can be integrated with control electronics.

It is another object of the invention to provide a micropump which can be fabricated from materials which do not react with the fluid being pumped.

It is another object to provide a micropump which clears out any bubbles in the fluid.

It is still another object to provide a micropump in which the fluid flow can be electronically controlled.

The foregoing and other objects are achieved by a micropump which includes a microchannel for conducting the fluid and a transducer for generating high-frequency longitudinal acoustic waves and directing the waves along said channel for interaction with the liquid to cause the liquid to flow along the channel in the direction of the acoustic waves.

BRIEF DESCRIPTION OF THE DRAWINGS

The foregoing and other object of the invention will be more fully understood from the following description read in connection with the accompanying drawings, wherein.

DESCRIPTION OF PREFERRED EMBODIMENT

In accordance with this invention, fluid is caused to flow along a microchannel by the interaction between a longitudinal acoustic wave and the fluid being pumped. More particularly, the fluid is impelled by an acoustic pressure gradient which can arise from streaming and/or radiation pressure. These effects are difficult to separate in an acoustic micropump in which fluids are pumped by longitudinal acoustic waves traveling along a microchannel. Streaming requires attenuation to occur, while radiation pressure is present at interfaces between media of different acoustic impedances. Radiation pressure can also be induced by causing a gradient in pressure either by a change of the intensity or the velocity of the wave. Classical examples of radiation pressure involve sound waves in one medium incident on an interface with another medium. This causes a reflection of the sound and a difference in intensity across the interface. The resulting pressure difference causes mound formation or fluid ejection in the direction of lower radiation pressure.

As will be apparent from the description to follow, pressure gradients provided by streaming and radiation pressure are used to pump fluids in microchannels in controlled amounts.

Figure 1:
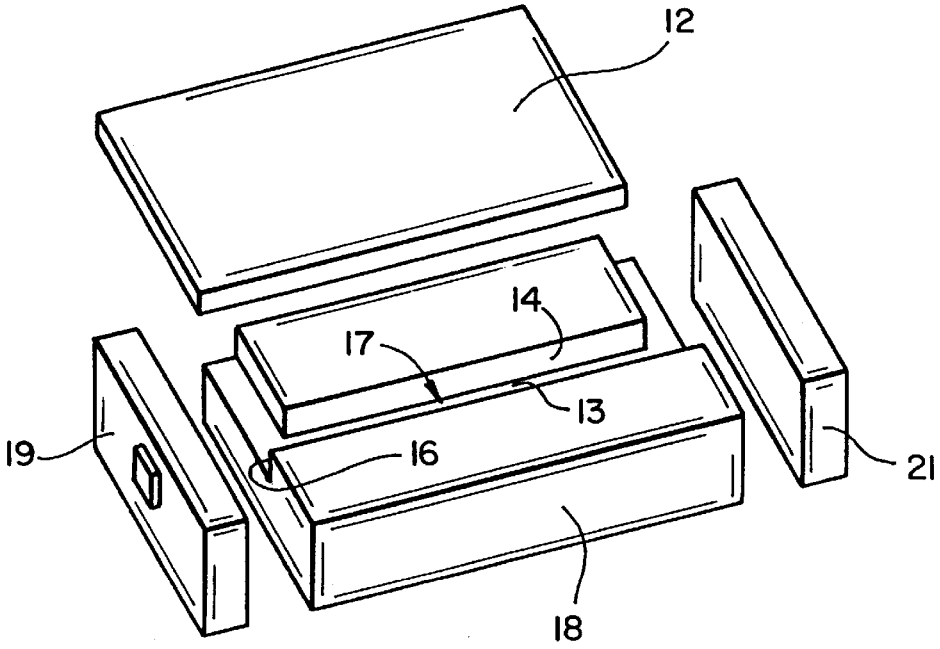
FIG. 1 is an exploded perspective view of an acoustic micropump in accordance with the invention.
Figure 2:
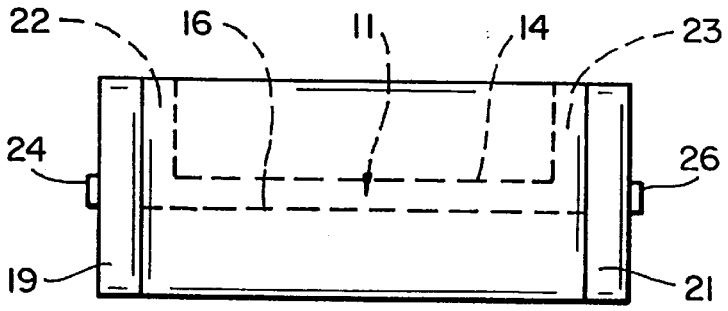
FIG. 2 is a top plan view of the acoustic micropump of FIG. 1.
Figure 3:
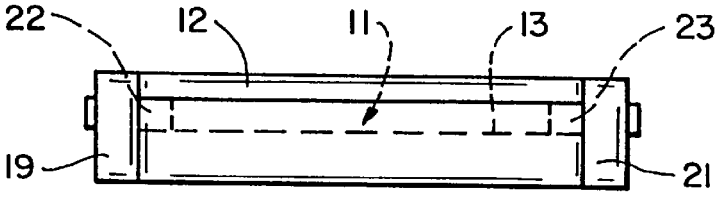
FIG. 3 is a side elevational view of the micropump of FIGS. 1 and 2.

An acoustic micropump is shown in FIGS. 1–3. The pump comprises a pumping microchannel 11 for conveying a fluid, having rigid walls defined by the cover 12, the bottom wall 13 and side walls 14, 16 of the groove 17 formed in the substrate 18. End walls 19, 21 are suitably bonded to the substrate and cooperate with the groove 17 and the cover 12 to define inlet and outlet microchannels 22, 23. Piezoelectric transducers 24, 26 are secured to the end walls 19, 21 opposite the pumping channel 11. The transducers generate longitudinal acoustic waves which travel along the channel responsive to a high-frequency input. Two transducers are shown to provide pumping in either direction. Only one transducer is required for unidirectional pumping. In the present embodiment the transducers are the same dimensions as the channel cross section. There will be presently described focused transducers for providing more acoustic energy to a microchannel.

As the acoustic waves travel down the channel 15 filled with the fluid being pumped, there is a loss in the intensity of the acoustic energy due to viscous damping or attenuation. This results in a force F, which forces the fluid in the channel to flow. The force is given by:

$$F=\rho_0\alpha A^2$$

Where $\rho_0$ is the density, $\alpha$ is the attenuation of the sound-per-unit length, and A the instantaneous particle velocity.

The loss in intensity of the acoustic waves propagated down the channel 11 due to viscosity of the fluid is given by: $I(z)=I_0e^{-2\alpha\alpha}$ where $\alpha$=0.0022 db/cm at 1 MHz for water at room temperature Since $\alpha$ scales as the square of the frequency, we can increase the attenuation to very large values by increasing the frequency. For example, if we operate at 600 MHz, the attenuation, $\alpha$, is approximately 1 dB per 12 $\mu$m. At 1 GHz, the attenuation is 1 dB per 5 $\mu$m. For single-mode propagation in a microchannel, sound frequencies of 1 MHz, 600 MHz and 1 GHz indicate channel widths and heights of 1.5 mm, 2.5 $\mu$m and 1.5 $\mu$m, respectively.

These energy losses are due to viscosity effects and can be used to do work on the fluid. As the intensity decays exponentially, this gradient will result in acoustic forces which will cause fluid to flow in the channel 11 in the direction of the sound waves.

In summary, in this type of operation it is important to introduce the sound into a fluid that has an attenuation coefficient. Once this is done, the fluid will flow in the direction of the sound wave. In this invention this is done using high frequency ultrasonics where the wavelength is small, and diffraction-limited focusing allows introduction of the ultrasonic beam into channels whose dimensions are of the order of microns.

Figure 4:
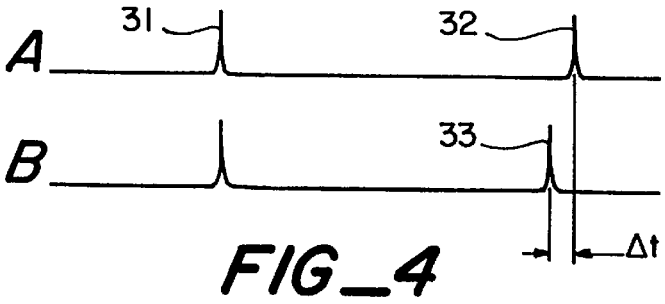
FIGS. 4A and 4B show acoustic pulse delay with no fluid flow and with fluid flow in a channel.

Referring again to the acoustic micropump of FIGS. 1–3 the two transducers 24 and 26 can be used to measure the fluid flow. For example, a pulse 31, FIG. 4, can be transmitted by transducer 24 and received after a delay, pulse 32, by transducer 26 with no flow. This provides a calibration. Thereafter when fluid is flowing the delay can again be measured. With fluid flowing in the direction of transducer 26, a pulse 33 received by transducer 26 will have a smaller delay. The difference in delay $\Delta t$ is a measure of the fluid velocity.

The acoustic pump of FIGS. 1–3 can be fabricated by well-known micromachining techniques. For example, the substrate 18 may be a silicon body. The upper surface can be masked with a suitable photoresist which is processed to expose the silicon at the channel location. The silicon can then be etched with a suitable etching solution for a predetermined time to provide the desired channel depth. The silicon end walls 19, 21 and cover 12 may then be bonded to the silicon substrate to provide the pumping channel and inlet and outlet channels. A pumping channel for operation at 50 MHz would be 30 $\mu$m high and 30 $\mu$m wide.

As the pumping channels get smaller for smaller micropumps, it is difficult to provide adequate acoustic energy directly from an acoustic transducer which is the same size as the channel opening. For further miniaturization the sound energy from a larger transducer is focused into the pumping chamber or channel.

Figure 5:
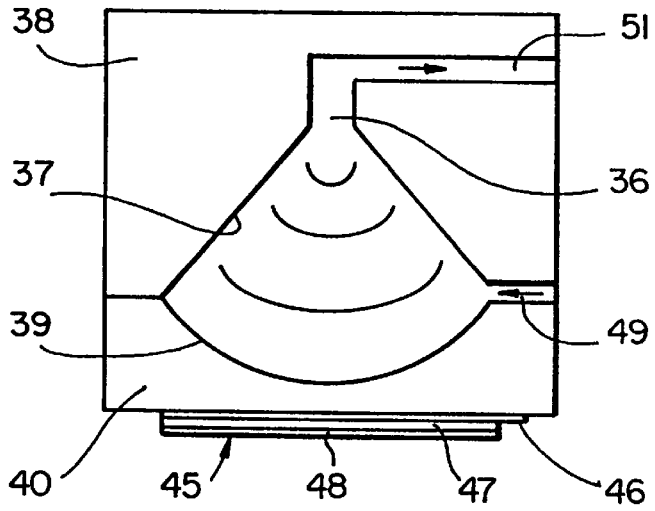
FIG. 5 is a schematic view showing an acoustic micropump using acoustic waves focused by a concave lens.

FIG. 5 shows an acoustic micropump using a classical lens design for focusing acoustic energy at the orifice of pumping channel 36. The channel 36 is formed by etching a hole at the end of the cone-shaped cavity 37 formed in a silicon member 38 by plasma etching. A lens 39 is isotopically etched in silicon substrate 40.

Figure 6:
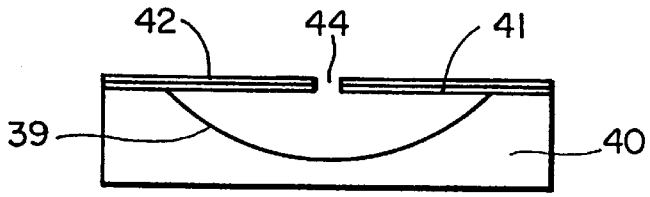
FIG. 6 is a sectional view showing how the focusing lens of FIG. 5 can be constructed.

Referring to FIG. 6, the lens 39 is formed by providing a silicon nitride layer 41 on the surface of a wafer or substrate 40 with an overlay gold layer 42, FIG. 6. A pin hole 44 exposes the underlying silicon. Isotropic etching forms the lens 39.

A piezoelectric transducer 45 is formed on the other surface of the substrate 40 opposite the lens 39. The transducer is formed by depositing a conductive layer 46, a layer 47 of piezoelectric material such as ZnO or PZT and a second conductive layer 48. The layers 41 and 45 serve as the contacts for exciting the piezoelectric material to generate longitudinal acoustic waves. The longitudinal waves are focused into the channel 36 by the lens 39. The acoustic pressure gradient pumps fluid from the inlet 49 through the pumping channel 36 to the outlet 51. By way of example, the lens could be 1 mm in diameter to match the open end of the cone shaped cavity. The opening of channel 36 may have a diameter of 10 $\mu$m.

Figure 7:
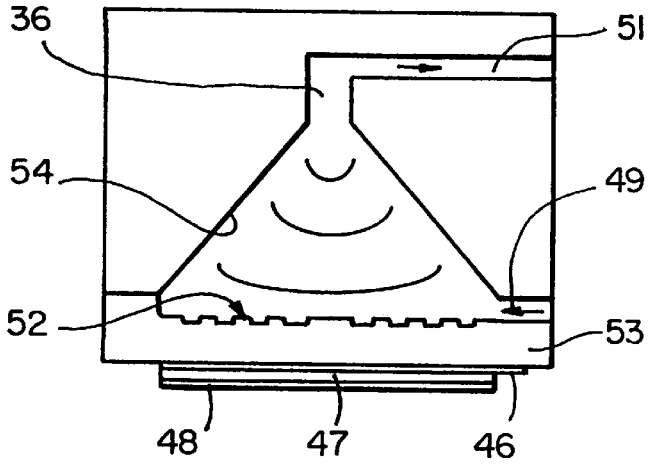
FIG. 7 is a schematic view of another acoustic micropump using acoustic waves focused by a Fresnel lens.

FIG. 7 shows an acoustic micropump which uses a Fresnel lens 52 to focus the acoustic waves into the orifice or channel 36 of the pumping channel. The Fresnel lens 52 is fabricated by masking and etching silicon substrate 53 or by depositing silicon or silicon oxide onto the surface through a mask formed on the surface of the silicon substrate. The cone-shaped cavity 54 can be formed in a glass substrate by wet etching or dry plasma etching.

Figure 8:
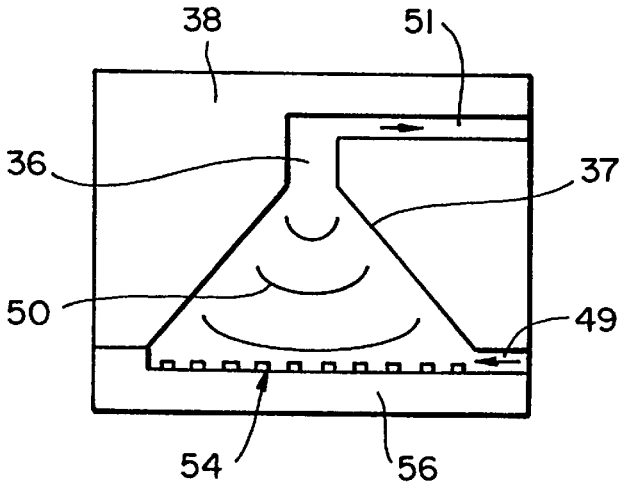
FIG. 8 is a schematic view of another acoustic micropump using acoustic waves focused by an interdigital transducer.
Figure 9:
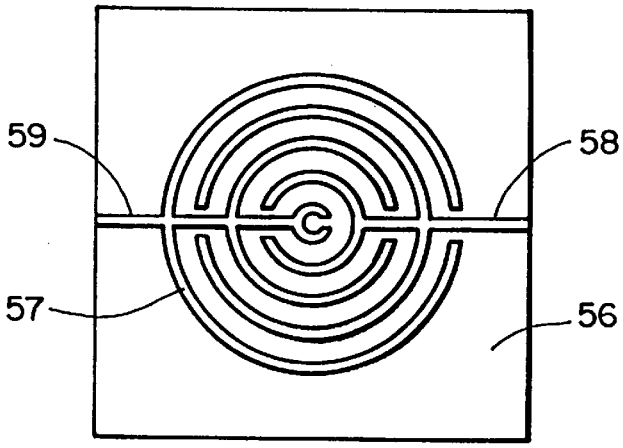
FIG. 9 is a schematic view of an interdigital transducer.

FIGS. 8 and 9 show an acoustic pump in which the focused acoustic waves are generated by an interdigital transducer 54. The interdigital transducer is formed on a piezoelectric substrate 56 by depositing conductive interdigital lines 57. By applying voltages to the leads 58 and 59, acoustic waves are generated in the material and mode-converted into a focused beam 50 which enters the channel 36. The transducer may be formed on the piezoelectric substrate, such as ZnO, or PZT, by applying a photoresist, exposing an electrode pattern and developing the pattern, depositing metal and lifting off the photoresist. Surface waves generated on the surface of the transducer are mode converted to focused longitudinal acoustic waves.

Figure 10:
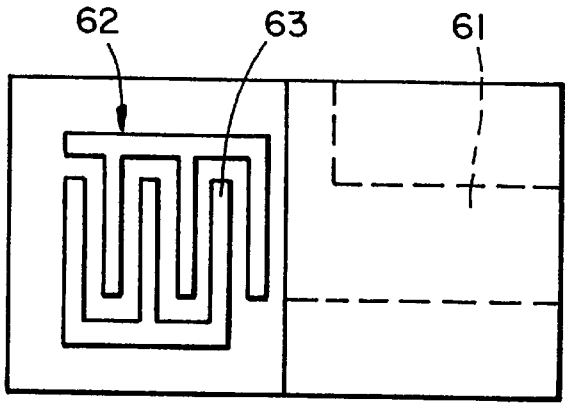
FIG. 10 is a schematic view of another acoustic micropump wherein the acoustic waves are generated by an interdigital transducer.
Figure 11:
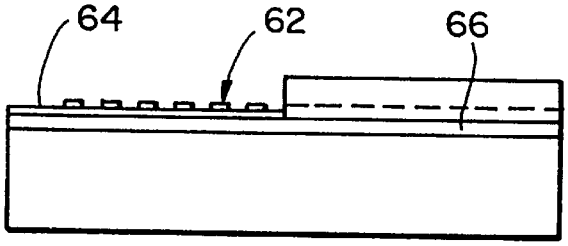
FIG. 11 is a side elevational view of the acoustic micropump of FIG. 10.
Figure 12:
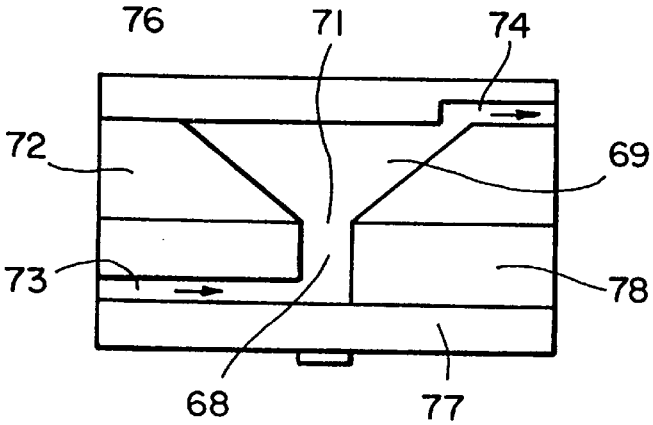
FIG. 12 is a schematic view of another embodiment of an acoustic micropump in accordance with the invention.

FIGS. 10 and 11 show an acoustic micropump in which an interdigital transducer produces Lamb waves which are mode converted to longitudinal waves traveling in a pumping channel 61. More particularly, a transducer 62 is formed by the interdigital conductors 63 formed on piezoelectric member 64. The transducer forms surface or Lamb waves which travel in the thin silicon member 66. As the waves travel along the channel 61 they are mode converted to longitudinal waves which provide an acoustic pressure gradient to pump fluid along the channel 61. The transducer 62 may be a focusing transducer such as shown in FIG. 12 to provide more intense Lamb waves at the channel 61.

The sound velocity and impedance in a restricted space are lower than those of free space. Thus, by propagating a sound wave in a waveguide 68 that terminates at an opening to a larger space 69 as shown in FIG. 12, the velocity will be lower and the intensity will be higher before the opening or orifice 71 than after the opening 71. Both of these will result in a decrease in the radiation pressure as the sound passes through the orifice. This radiation pressure gradient will push on the liquid at the orifice 71 resulting in fluid flow. Since the velocity and impedance of the sound is a function of frequency, the flow rate can be controlled by controlling the frequency of operation. The closer the frequency is to the cutoff frequency of the waveguide, the larger the velocity difference and the radiation pressure. The pump shown in FIG. 12 includes a silicon member 72 etched to form the space 69 which is connected to inlet 73 and outlet 74 defined by channels between the cover 76 and the silicon member 72 and between the silicon member 76 and transducer substrate 77. The velocity of sound propagation in a waveguide is related to how close the sound frequency is to the cutoff frequency of the waveguide. The cutoff frequency of a waveguide is proportional to the radius of the waveguide.

Figure 13:
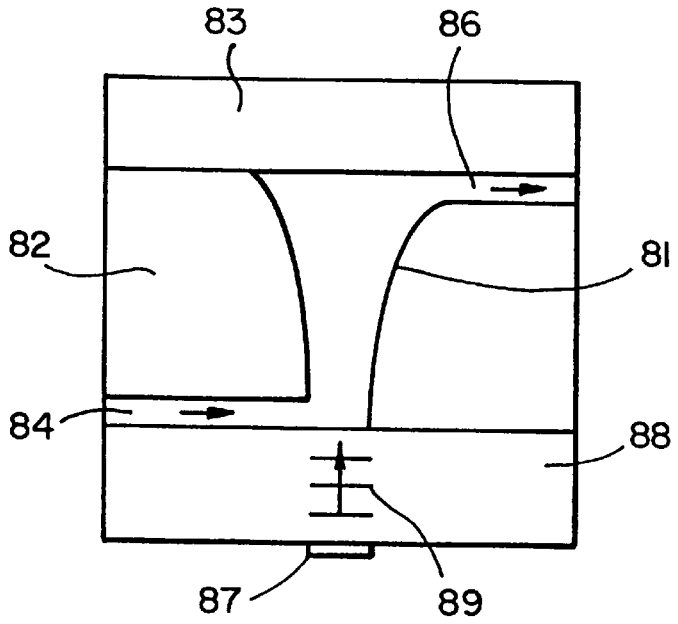
FIG. 13 is a schematic view of an acoustic micropump in accordance with a further embodiment of the invention.

If we fabricate a waveguide with a diameter that has a taper in it, the velocity will have a gradient which gives rise to a gradient in the radiation pressure. FIG. 13 illustrates an acoustic micropump having a tapered waveguide 81 formed in a silicon oxide substrate 82. The tapered waveguide may be formed by plasma etching. A cover member 83 is placed on the end of the substrate to close the end of the waveguide 81. Inlet and outlet openings 84, 86 are formed in the substrate 82. A transducer 87 is formed on a silicon member 88 and the member is attached to the substrate 82. The transducer generates longitudinal acoustic waves 89 which enter the small end of the waveguide.

The velocity of sound in a waveguide is related to how close the sound frequency is to the cutoff frequency of the waveguide. The cutoff frequency is related to the diameter of the waveguide. Thus the velocity of sound in the tapered waveguide 81 will have a gradient which gives rise to a gradient in the radiation pressure and causes the fluid in the guide to be pumped from the inlet to the outlet.

The acoustic velocity in a guided tube varies with the cross-sectional area as:

$$\alpha \propto \frac{1}{A}$$

$$v = c_0 - \frac{c_0^2 \alpha}{\omega}$$

Where A is the waveguide cross-sectional area, $C_0$ is the speed of sound in the fluid, ω is the radial frequency, and v is the propagation velocity. Thus, as A increases, the radiation pressure will decrease, and the differential pressure will force flow. The wavelength is larger than the waveguide dimensions, and consequently the pump operates at low frequency. This is a desirable mode of operation where flow in induced with no heating of the fluid. Heating of the fluid happens because of attenuation through viscous damping, which is the normal way of getting the pressure difference as explained in earlier sections.

Figure 14:
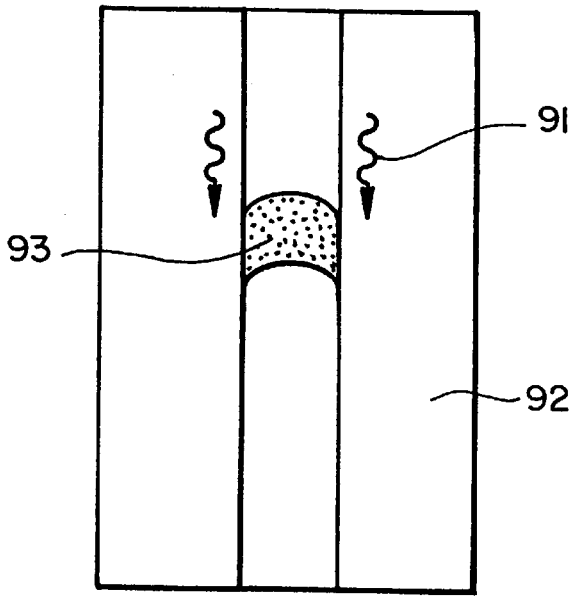
FIG. 14 schematically shows a tubular acoustic micropump.

FIG. 14 shows a surface wave 91 on the inside of a circular or rectangular pipe 92. If a fluid drop 93 or fluid column is suspended inside the pipe, the surface wave will convert into a longitudinal wave in the fluid, and entrench the fluid drop in the direction of propagation of the wave. The surface wave can be generated by placing a circular or rectangular transducer at the end of pipe 92.

Figure 15:
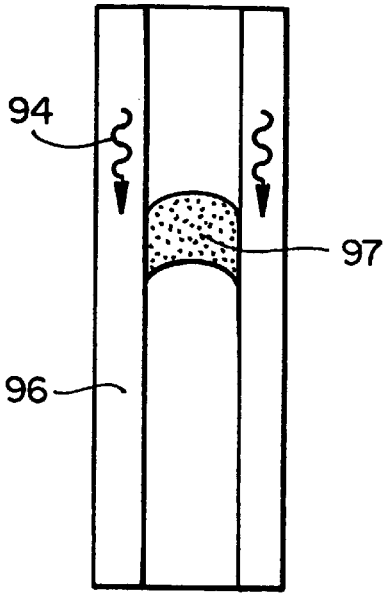
FIG. 15 schematically shows another tubular acoustic micropump.
Figure 16:
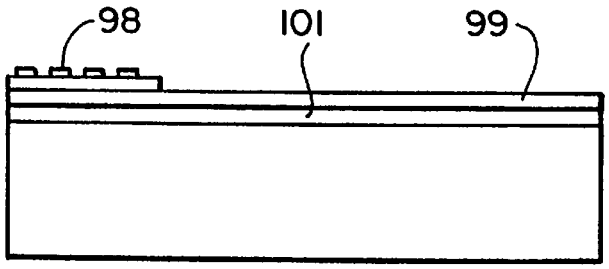
FIG. 16 shows an acoustic micropump using Lamb waves which are mode-converted to longitudinal acoustic waves.

The same type of phenomenon can take place with plate waves that are often referred to as Lamb waves. In this case, the wave propagates in a plate, and can leak as a longitudinal wave into a fluid on one side of the plate. The one complication is that there are an infinite number of plate modes. Hence, the mode of propagation should be chosen properly to leak, as a longitudinal wave, into the fluid. FIG. 15 schematically illustrates a micropump using Lamb waves 94 propagating in a pipe 96 to pump a fluid drop 97 or fluid column. Lamb waves can propagate in a plate which is placed over a substrate with a fluid in the space between the plate and the substrate. A pump using interdigital transducers 98 generating Lamb waves in plate 99 to pump fluid in channel 101 is schematically illustrated in FIG. 16.

Figure 17:
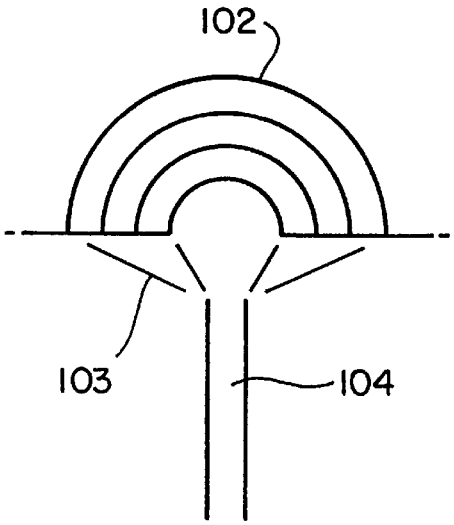
FIG. 17 schematically shows an interdigital transducer focusing acoustic energy into a channel.

Interdigital transducers can be focused in the direction into the paper so that the focus of the acoustic beam, which could be of the order of a wavelength, could be applied to the entrance of the channel to carry the fluid. FIG. 17 schematically shows an interdigital transducer 102 forming an acoustic beam 103 which is focused at the entrance of channel 104. The longitudinal acoustic wave traveling on the channel 104 will cause fluid flow.

Figure 18:
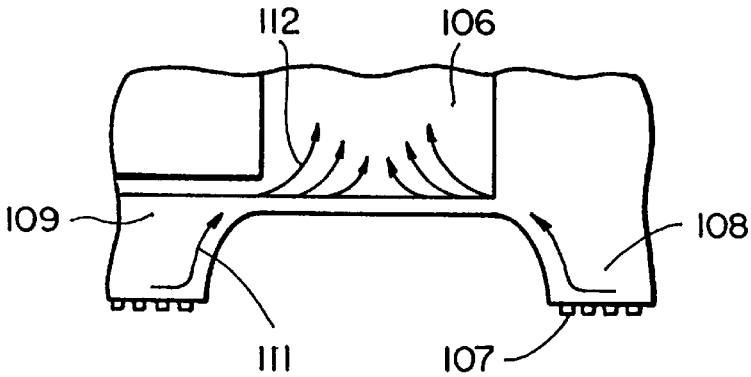
FIG. 18 shows an acoustic micropump wherein the acoustic waves are generated by a circular interdigital transducer using waves and mode conversion.

FIG. 18 shows a transducer for applying longitudinal acoustic waves to the channel 106. A ring-shaped interdigital conductive pattern 107 is formed on the lips 108 of the cup-shaped piezoelectric body 109. By applying voltage to the interdigital conductive pattern Lamb waves 111 are generated. The waves are mode-converted to longitudinal waves 112 when they contact the fluid in the pumping channel 106. They provide an acoustic pressure gradient.

When sound (acoustic waves) propagates down a channel similar to that in FIG. 1, and small air bubbles are present in the fluid, the sound will be scattered by the bubbles, and the scattered energy is given by:

$$\frac{I_0(\theta)}{I_i} = \frac{k^4 a^6}{9r^2}\left[\frac{3(1-\rho_{air}/\rho_{water})}{1+2\rho_{air}/\rho_{water}}\cos\theta + \left\{1\frac{k_{water}}{k_{air}}\right\}\right]^2$$

If we integrate over all angles and insert physical values, this reduces to:

$$\frac{\text{Power scattered}}{I_i} = \frac{4\pi k^4 a^6}{9} 3.6 * 10^8,$$

$$\text{where } k = \frac{2\pi}{\lambda},\ a = \text{bubble radius}$$

This scattering results in a large attenuation as the sound wave passes through the bubbles. This causes a radiation pressure on the bubbles and pushes them, as well as the fluid, down the tube. By varying the number and size of the bubbles and the frequency of the sound, the scattering losses can be controlled. Thus, we have a system where air bubbles can be used to push the fluid, and it is not inconceivable to introduce air bubbles to force flow. Of course, care has to be taken to avoid trapping bubbles at corners.

Another aspect of this configuration is that if the fluid is not homogeneous, and contains molecules or particles that have different density and elasticity from the fluid, these particles will sense a radiation force that will entrench them and force fluid flow.

By using materials such as silicon and glass or quartz for the fluid pumps which have been described, it is possible to use micro machining techniques developed by the semiconductor industry to fabricate the fluid pumps. This provides the advantage of integration with control electronics, batch processing, high yield and small size. To create the channels with specific side wall slopes and size, it is possible to use plasma etching. By varying the pressure, plasma mixture, mask material and r.f. power, the shape of side walls can be controlled accurately. As used herein, "channel" includes the structures having tapered or conical shapes shown in the various figures. As an example, spherical lenses of any radius can be formed by isotropic etching in silicon. Whereas, Fresnel lenses can be made with two or more phases using standard lithography processes.

The transducer can be made from either ZnO, PZT or other piezoelectrics. ZnO provides the best performance at the frequencies of interest and is easily integrated with conventional semiconductor processing. Other processing techniques such as wet isotropic etching, photolithography, and metal evaporation are used to complete the fabrication processes.

In general, operating at high frequency is the preferred domain of operation in a miniaturized device. In this range, the wavelength of the sound in the fluid is quite small (150 $\mu$m at 10 MHz), and force could be applied in channels or structures that are quite small. Of course, even smaller wavelength of sound can be used by increasing the frequency of operation. Using IDTs and thin piezoelectric films allows operation up to several hundred megahertz.

Using multiple pumps as sources allows the movement and manipulation of several fluids. By applying different powers to the transducers, different speeds and mixing propagations can be controlled electronically.

The small size and compatibility with integrated circuits and batch processing allow these pumps to be connected in either series or parallel configurations. If the pumps are connected in series, the applied fluid pressure will sum together. If the pumps are connected in parallel, the flow rates will sum. By changing the parameters of the system, electrical power used, and the configuration used, flow rates from n1/min to m1/min with pressures from 1 torr to 1000 torr are possible. This wide range of possible pumping parameters allow a wide range of possible application.

One major branch of applications involve medical applications. Blood, insulin, hormones, and other drugs could be administered in vivo. By designing a waveguide to be small enough so that only a single blood cell can travel down it, a cell counter could be fabricated. Additionally, in the manufacture of drugs with precisely controlled trace substances could be mixed using a micro pump. Other applications include chemical analysis, on-chip cooling systems, mass spectrometers, and the analysis of the mechanics of fluid on a micron scale.

What is claimed:

1. An acoustic micropump for pumping fluids comprising:

a pumping channel having a cross sectional area between 6.25 $\mu m^2$ and 2.25 $mm^2$ for conveying the fluid; and an acoustical transducer responsive to a high-frequency input for generating and directing longitudinal acoustic waves having a frequency between 1 GHz and 1 MHz, respectively, into one end of said channel whereby the longitudinal acoustic waves induce a pressure gradient in fluid disposed in the channel, said pressure gradient forcing the liquid in the channel to flow in the direction of travel of the longitudinal acoustic waves.

2. An acoustic micropump as in claim 1 wherein said transducer is configured to focus said longitudinal acoustic waves into said channel.

3. An acoustic micropump as in claim 2 wherein said transducer is an interdigital transducer.

4. An acoustic micropump as in claim 1 wherein said transducer includes a lens for focusing longitudinal acoustic waves into said channel.

5. An acoustic micropump as in claim 4 wherein said lens is a Fresnel lens.

6. An acoustic micropump as in claim 4 wherein said lens is a classical lens.

7. An acoustic micropump as in claim 1 wherein said channel opens into a larger space whereby the acoustic wave intensity is higher and acoustic velocity lower before the opening whereby there is a decrease in radiation pressure as the acoustic waves pass through the opening whereby the fluid is caused to flow in the direction of reduced radiation pressure.

8. An acoustic micropump as in claim 2 wherein the channel is tapered to have an increasing cross-section in the direction of travel of the longitudinal acoustic waves to generate a pressure gradient.

9. An acoustic micropump as in claim 2 wherein said acoustic transducer generates Lamb waves which travel in a thin member and are mode-converted to longitudinal acoustic waves at the channel.

* * * * *